US005309676A

United States Patent [19]

Appelmann et al.

[11] Patent Number: 5,309,676

[45] Date of Patent: May 10, 1994

[54] BALANCED DOOR CLOSING APPARATUS

[75] Inventors: Horst J. Appelmann, Pickering; Edmund Dee, Scarborough, both of Canada

[73] Assignee: C. J. Rush A Division Of Derlan Manufacturing Inc., Agincourt, Canada

[21] Appl. No.: 917,646

[22] Filed: Jul. 23, 1992

[51] Int. Cl.[5] ..... E05D 15/28

[52] U.S. Cl. ..... 49/253; 16/64; 16/69; 49/386

[58] Field of Search ..... 49/250, 251, 252, 253, 49/260, 261, 386; 16/69, 70, 64, 65, 79

[56] References Cited

U.S. PATENT DOCUMENTS 2,019,527 11/1935 Ellison ..... 49/252
3,456,388 7/1969 Hanson et al. ..... 49/386 X
3,605,339 9/1971 Catlett et al. ..... 49/253 X
3,675,370 7/1972 Catlett ..... 49/253

*Primary Examiner*—Philip C. Kannan
*Attorney, Agent, or Firm*—Bereskin & Parr

[57] ABSTRACT

A door closer is shown, which is installed between a door and a door frame, in a balanced door. The door closer is installed in a header of the door frame, and includes an operative connection to a hinge shaft upon which upper and lower door support arms pivot. The operative connection includes a first gear mounted on a check shaft which engages a second gear mounted on the hinge shaft. The second gear preferably has a larger effective diameter than the first gear whereby the limited rotation of the hinge shaft results in a greater rotation of the check shaft to fully utilize the closer functions.

10 Claims, 6 Drawing Sheets

BALANCED DOOR CLOSING APPARATUS

FIELD OF THE INVENTION

This invention relates generally to the field of balanced doors. A balanced door may be considered to be a door which has a axis of rotation relatively close to its centre moment of area. In this manner, the door may be opened with less effort than a conventional door which is hinged at one side. In particular, this invention relates to a door closing apparatus primarily for use in association with such a balanced door.

BACKGROUND OF THE INVENTION

Manually operable balanced doors are known and have been used fairly extensively in modern buildings. In a typical construction, the balanced door is mounted in a doorway comprised of an upper header, a pair of side jambs, and the base. A hinge shaft is disposed in one side of the door frame, from which extend upper and lower door pivot arms. A guide track is mounted in the underside of the header, and a cylindrical guide roller is mounted on the top of the door. The door then rides on the pivot arms, with the cylindrical guide roller guided within the guide track. A door closer is usually disposed within the frame header to control the rotation of the door. The door closer will prevent the door from being opened too far so as to prevent damage to the guide roller or the door itself, and is also intended to provide additional force to close the door, but without having the door bang closed.

In one prior version, a linkage mechanism is disclosed within the header to couple the check shaft of the door closer to the hinge end of the upper door pivot arm so that the closer applies a rotational force to the upper pivot arm. This is disclosed in U.S. Pat. No. 3,605,339 which issued Sep. 20, 1971 to Catlett et al. However, this prior arrangement has been unsatisfactory because the linkage does not provide enough control to allow the door closer to adequately work over an extended range of opening and closing. In addition, the linkage is unreliable and prone to breakage In U.S. Pat. No. 4,286,411 a different configuration is proposed, in which an additional door closer arm (an example of which is shown as 18 in the FIG. 1) is used. However, the door closer arm is again subject to failure and additionally represents an extra arm extending outwardly from the header to the door. Such a door closer arm is unsightly and disturbs the clean lines of the door. Further, this door closer arm does not provide sufficient rotation of the check shaft of the door closer to provide as much control as may be desired, because due to geometry, the door closer arm only moves through a limited arc of about 130°.

SUMMARY OF THE INVENTION

What is desired is a door closer linkage which permits a full degree of rotation of a door closer check shaft, and yet one which is robust, reliable, and not unsightly. The present invention discloses a door closing apparatus for use in association with a balanced door having a door frame comprising a header, a base, and a pair of side jambs to define the door opening, one of said jambs having a hinge shaft disposed therein, and a door mounted in said door opening on an upper and a lower door pivot arm extending from said hinge shaft, said door having at least one guide roller guided by said frame, said door closing apparatus being mounted between the door and the frame, and comprising:

a door closer body having an operative element extending from one end of said body;

a first gear means having a first effective diameter connected to said operative element; and a second gear means having a second effective diameter mounted on an end of said hinge shaft;

wherein said door closer body is mounted adjacent said hinge shaft and said first gear means engages said second gear means to operatively connect said door closer to said door.

BRIEF DESCRIPTION OF THE DRAWINGS

Reference will now be made to a preferred embodiment of the invention by way of example only with reference to the following drawings in which.

DETAILED DESCRIPTION OF PREFERRED EMBODIMENTS

Figure 1:
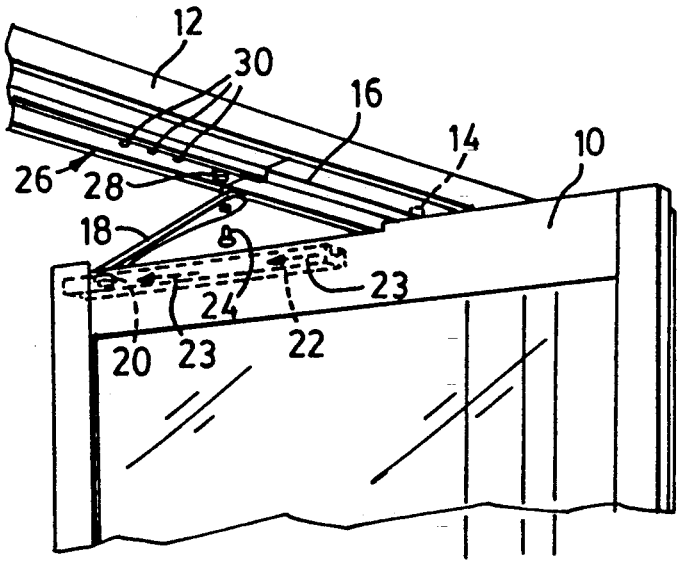
FIG. 1 (PRIOR ART)
FIG. 1 is a perspective view of a prior art balanced door closing apparatus.

Prior to describing the instant invention, it is useful to consider the prior art configuration as illustrated in FIG. 1. FIG. 1 shows a door 10 in a door frame 12. A guide roller 14 is shown in a guide track 16. The guide track 16 is supported in a door frame 12 and the guide roller 14 is attached to the top of the door 10. A door closer arm 18 is also shown with a door closer roller 20 which rides in a guide track 22 mounted in the door 10. At the other end the door closer arm 18 has an attachment pin 24 to attach it to a door closer 26 at a check shaft or operative element 28. Also shown are door closer adjustment access holes 30. As can be seen, in this configuration the door closer arm 18 extends between the door 10 and the door frame 12 and is fully exposed to view, as the door is opened.

Figure 2:
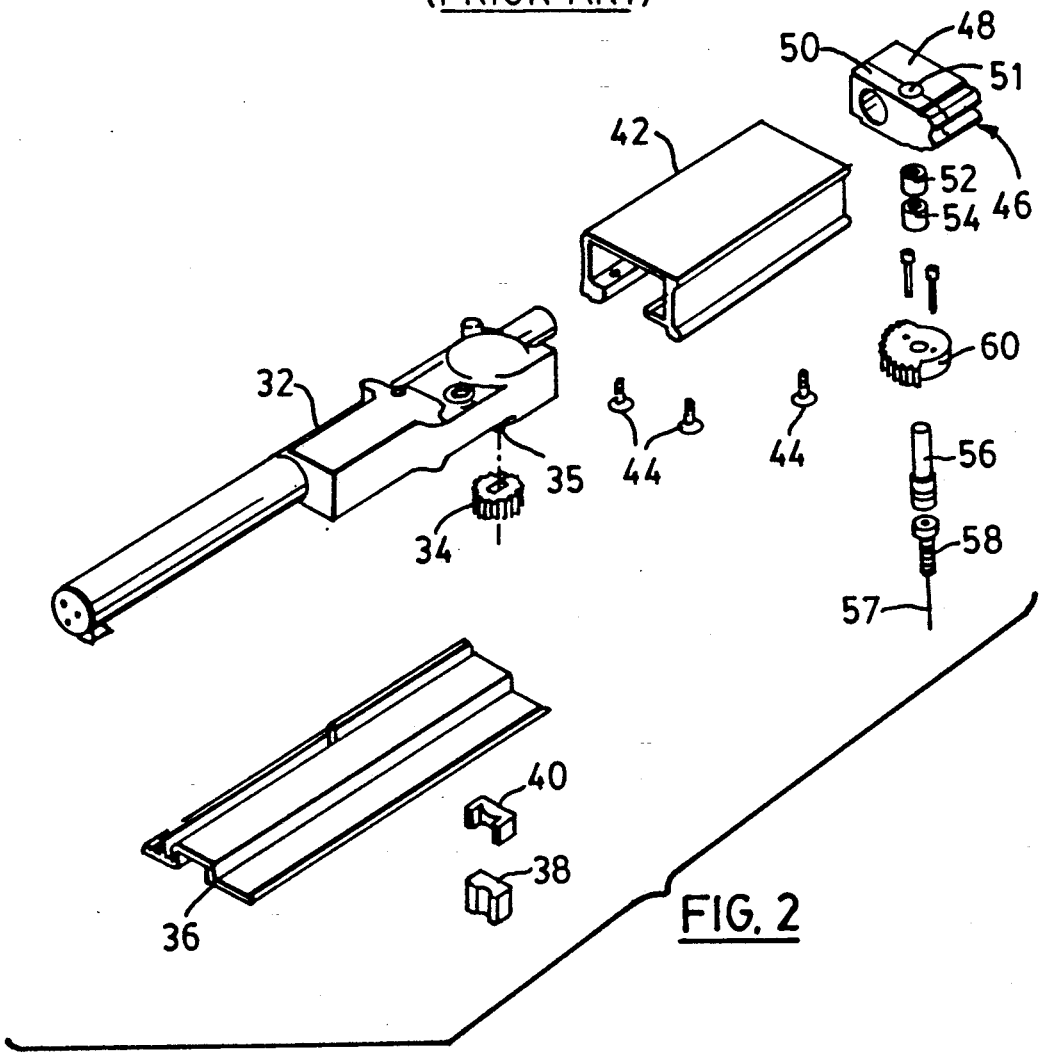
FIG. 2 is a break-away view from above of a balanced door closing apparatus according to the present invention.

Turning to FIG. 2, the primary components of the present invention are shown. A door closer 32 is shown with a gear means 34 which is mounted on a check shaft or operative element 35 of the door closer 32. Also shown is a guide roller track 36 which includes a bumper 38 and a bumper mount 40. Preferably the bumper 38 is made from tough yet flexible resilient rubber, while the bumper mount 40 may be made from steel or the like. The purpose of the bumper 38 and bumper mount 40 are explained below.

The door closer 32 is mounted within an extruded section 42 by means of mounting screws 44, 45. Preferably the extruded section 42 is made from aluminium. The extruded section 42 becomes a customized holder to hold the closer 32 in place securely within the door frame. A secure mounting of the door closer 32 is important for the smooth operation of the instant invention as is described below.

Also shown is a needle bearing 46 with split halves 48 and 50. Fitting inside the needle bearing 46 between the split halves 48 and 50, and located within a bore 51 formed between the split halves 48,50 of the needle bearing 46 are bearing elements 52, 54 which accommodate a shaft element 56 mounted above a screw 58. Between the shaft element 56 and the bearing elements 52, 54 is mounted a second gear means 60 which is described in more detail below. The shaft element 56, the bearing elements 52,54, and the screw are all on the same centreline shown as axis 57 which extends through the second gear means 60 and in between the split halves 48 and 50 of the needle bearing 46, in the bore 51.

Figure 3:
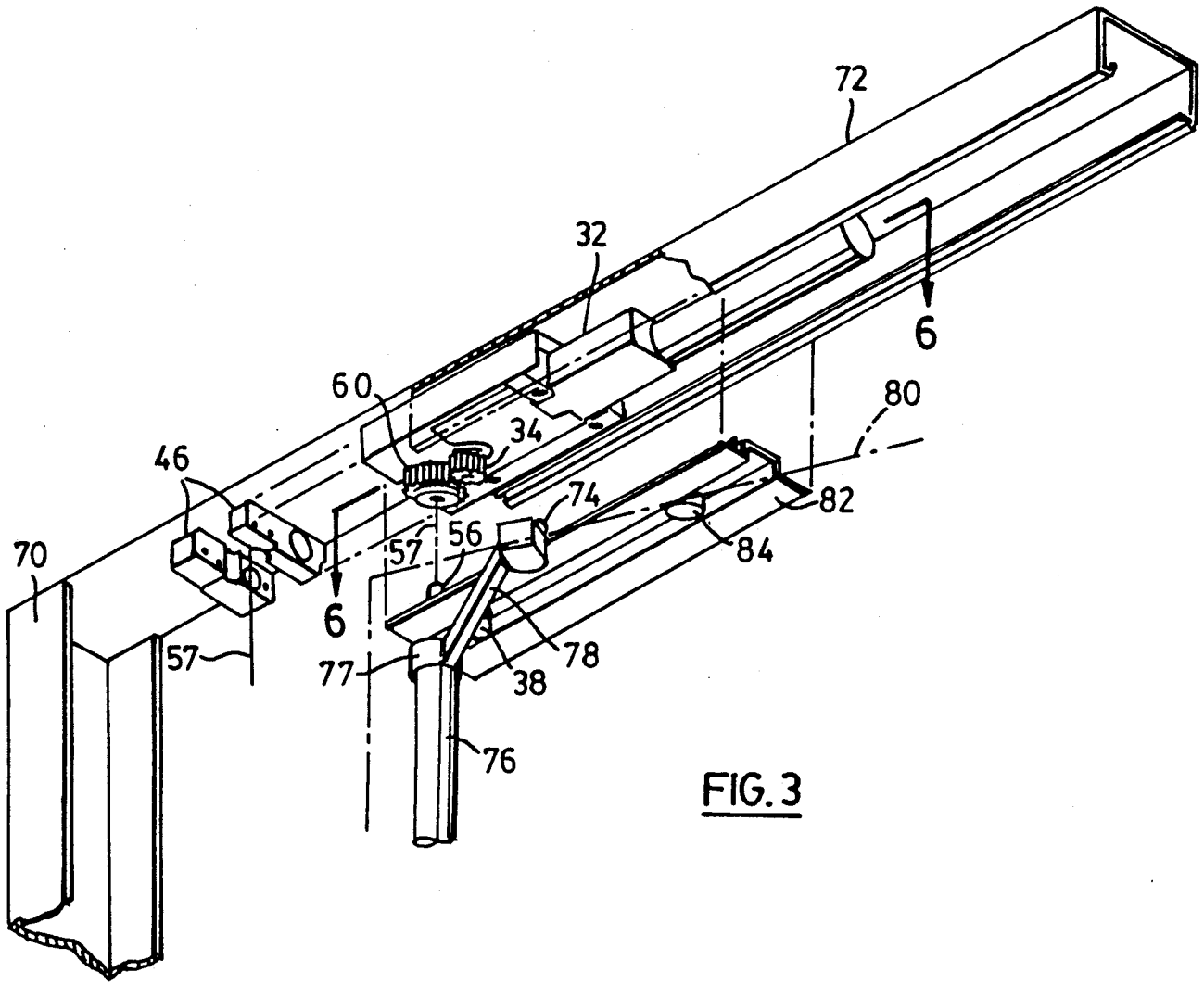
FIG. 3 is a view from below of the apparatus of FIG. 2 in position between a door frame and a door.

Turning to FIG. 3, the installation of the present invention between a door and a door frame is illustrated. A side door jamb is shown at 70 with a top door frame element or header shown at 72. Within the header 72 is located the door closer 32. Also shown are the first gear means 34 and the second gear means 60. The shaft element 56 is shown secured to a hinge shaft 76 which has mounted close to its end a door support arm 78. One end of the door support arm 78 is pivotally attached to a door 80 and the other end is rigidly attached to the hinge shaft 76. Although not shown in this figure it will be understood that an similar door support or pivot arm is located at the bottom of the door 80, which works parallel to and in concert with the upper door support or pivot arm 78.

Also shown located within the header 72 is a guide roller track 82 in which a guide roller 84 travels. The purpose of the guide roller 84 and track 82 is to allow the alignment of the door to be maintained during the opening and closing of the door 80. The purpose of the bumper 38 can now be understood. When the door 80 is fully opened, the roller 84 will travel to the far end of the track 82, adjacent to the door jamb 70. The bumper 38 prevents the roller 84 from banging into the end of the track 82 and absorbs some of the energy to cushion the end point of the door 80 travel.

Figure 4:
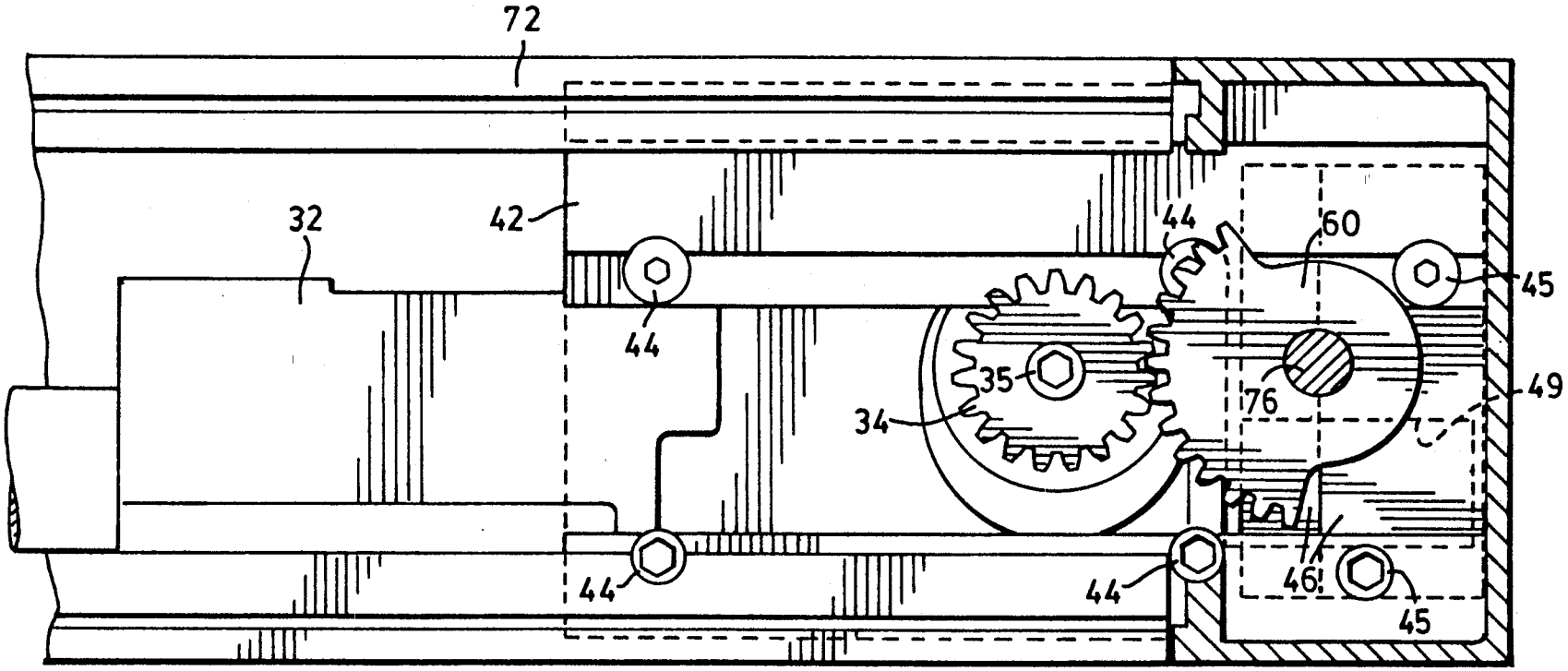
FIG. 4 is a top view of a door closing apparatus installed between a door frame and a door.

FIG. 4 shows a view from below of the apparatus according to the present invention. As can be seen, the first gear means 34 is in a form of a regular round gear which is mounted onto a check shaft or operative element 35 of the door closer 32. The first gear means 34 has a first effective diameter, which may be considered as that diameter which extends sufficiently from the operative element 35 of the door closer 32 to interact with the second gear means 60, while at the same time allowing a sufficient number of gear teeth to be presented to allow for the desired amount of rotation of the first gear means 34 relative to the second gear means 60. Satisfactory results have been achieved by using a gear having 32 teeth and a nominal diameter of 1½".

The second gear means 60 is a somewhat differently configured component. As shown the second gear means 60 is really in the form of a pinion which preferably has 18 teeth. The second gear means 60 takes into account a limited range of movement of the door 80 and translates limited rotational movement of the door 80 into a greater rotational movement of the operative element 35 of the door closer. When the door closer is installed the 32 teeth of the first gear means 34 are meshed with the 18 teeth of the second gear means 60 and will remain meshed during the entire swing of the door support or pivot arm 78 and hence of the hinge shaft 76. As will now be appreciated the effective diameter of the second gear means 60 is greater than the effective diameter of the first gear means 34. Thus a lesser degree of rotation of the door pivot arm 78 (which being rigidly attached to the hinge shaft 76 will be the same as the rotation of the hinge shaft 76) can be translated into a greater amount of rotation of the first gear means 34 and hence of the check shaft 35. Satisfactory results have been achieved where a rotation of 90 degrees of the door pivot arm translates into 160 degrees of rotation of the check shaft 35. It will be appreciated by those skilled in the art that the relative rates of rotation can be varied, but that what is important is to choose a degree of rotation that is appropriate for the effective operation of the door closer as outlined below.

Also shown are the attachment screws 44 for screwing the door closer into the door frame. It will now be appreciated that the secure attachment of the door closer 32 to the frame or header 72 is important to the smooth functioning of the present invention because of the inter action between the first gear means 34 and the second gear means 60. Satisfactory results have been achieved with four screws 44 as shown although the precise number and location of screws 44 can be varied. It will also be appreciated that by positioning the door closer 32 so that the first gear means 34 engages the second gear means 60 requires that the closer 32 be located closely adjacent the side jamb having the hinge shaft 76 mounted therein. To accommodate the closer 32 in such close proximity requires a bore 51 to be formed in the split or needle bearing 46. This is advantageous though because the overall width of the door can be reduced resulting in narrower balanced doors than were previously available.

Figure 5:
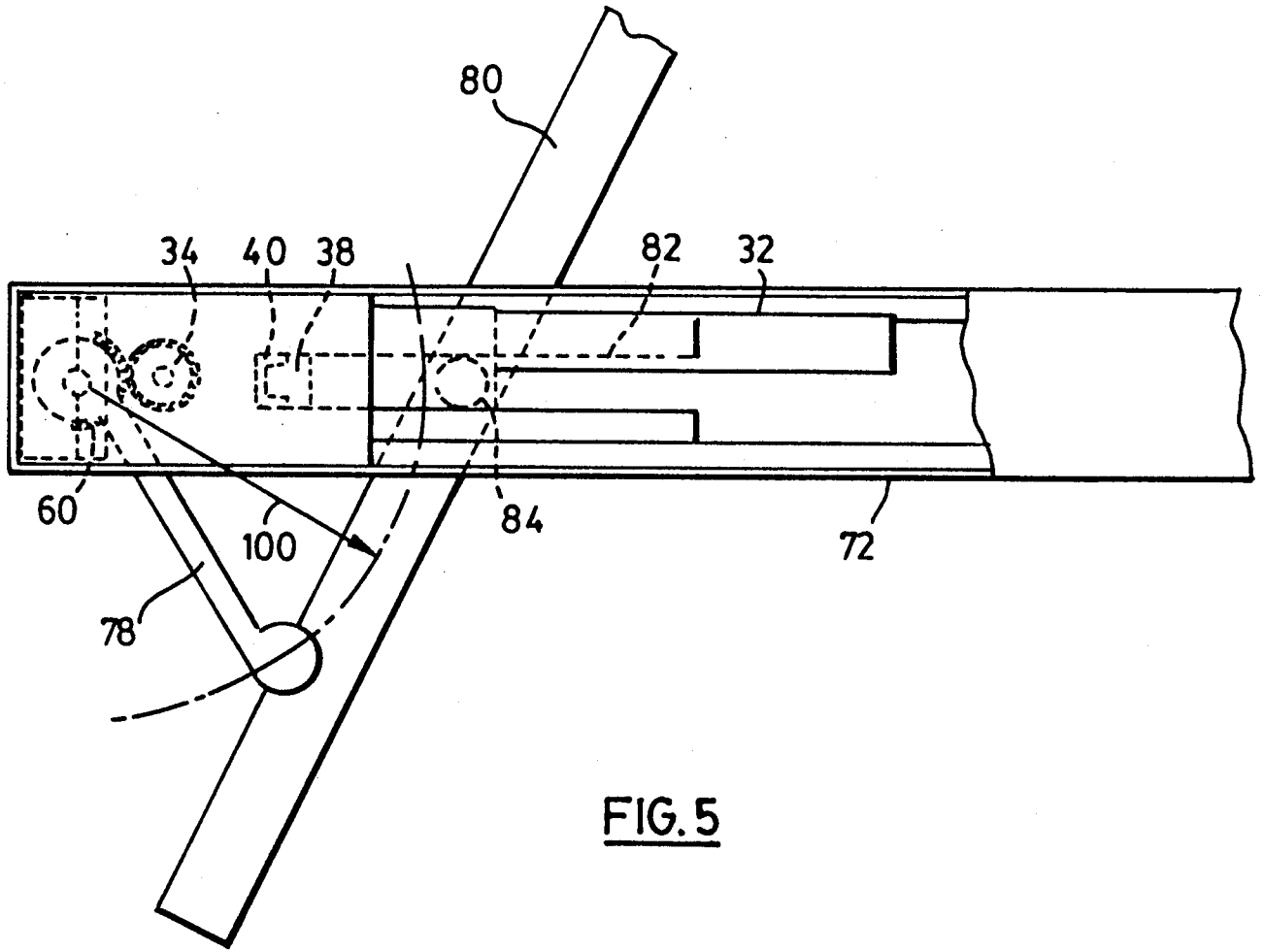
FIG. 5 is an assembly view of the door closing apparatus of FIG. 4 invention where the door is partially opened.

FIG. 5 shows the instant invention from above with the door 80 partly open. The door support arm 78 is shown with its pivotal path indicated by a radius 100. Guide roller 84 has travelled laterally in the track 82 and if the door 80 was opened further would continue until it hits the rubber bumper 38 in the bumper mount 40. The first gear means 34 is shown interacting with the second gear means 60. In this configuration the door has been opened about 45 degrees but the check shaft 35 will have been rotated about 80 degrees.

Figure 6:
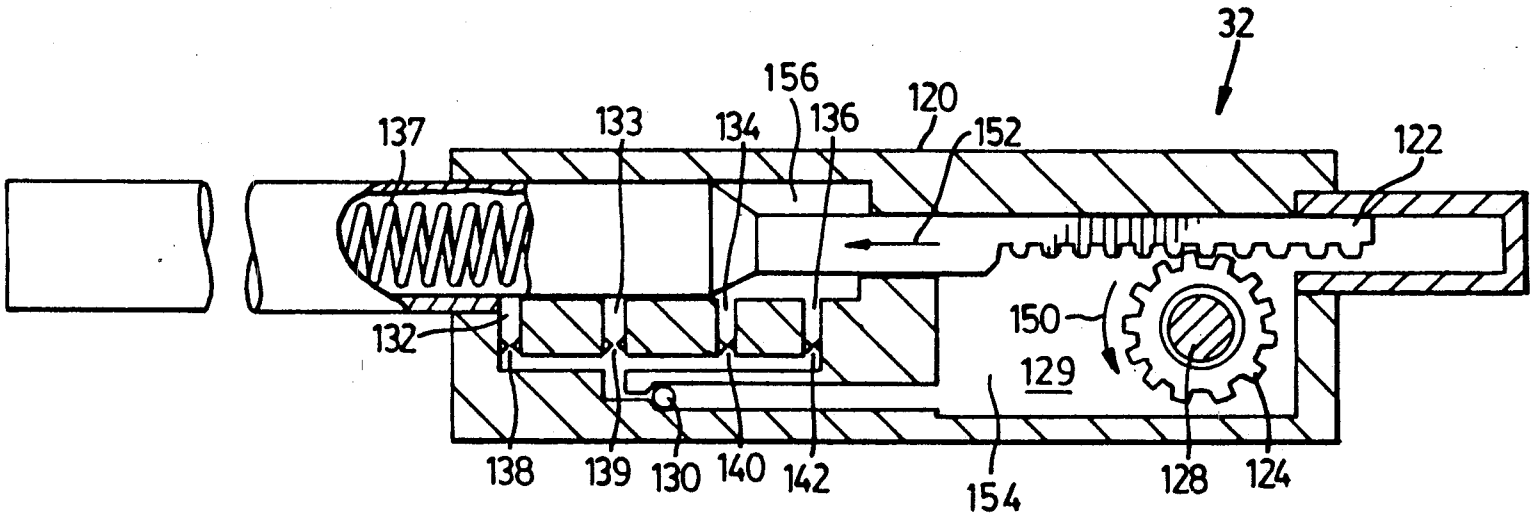
FIG. 6 is a cross-sectional view through lines 6—6 of FIG. 3.

FIG. 6 is a cross-sectional view through the door closer itself. Within the door closer body 120 is located a rack 122 and a pinion 124. The pinion 124 is mounted on a shaft 128 which in essence is the operative element or check shaft 35 which extends out of the door closer body 120. A fluid reservoir 129 is shown with a check valve at 130. A plurality of fluid passageways 132, 134, 136 are provided and a return spring 137 is located at the far end of the rack 122. Adjustment screws (not shown) can be used to vary the size of the various channels and operate as valves 138,139,140, and 142, for the purpose of causing slower or quicker action on the door closer.

The internal operation of the door closer is important to the operation of the present invention. When the door 80 is opened, the check shaft 35 will rotate causing the pinion 124 to rotate in the direction of the arrow 150. This causes the rack 122 to move in an outwardly direction shown at 152. This compress the spring 137 which then is urging the rack 122 to return to its rest position. This in turn of course causes the hinge shaft 76, the door pivot arm 78, and the door 80 all to be returned to the closed position.

During the outward stoke of the rack 122 the fluid is allowed to flow freely from a reservoir portion 154 into a reservoir portion 156.The primary resistance to the door opening operation then becomes the return spring 137. However on the return stroke each of the valves, 138,139,140,142 can be adjusted to limit the flow of fluid through the respective channels 132,133,134,136. Thus the closing speed of the door can be slowed for example at the end of its travel by allowing only a small volume of fluid to trickle through the channel 136. However effective use of the valves and channels can only be accomplished by ensuring that the rack 122 is fully travelling with each stroke (i.e. with each door opening and closing). Also for effective closing of the door it is necessary that there be some force left in the spring at the end of its travel. This is typically provided for by initially compressing the spring 137 upon its insertion into the assembly.

Figure 7:
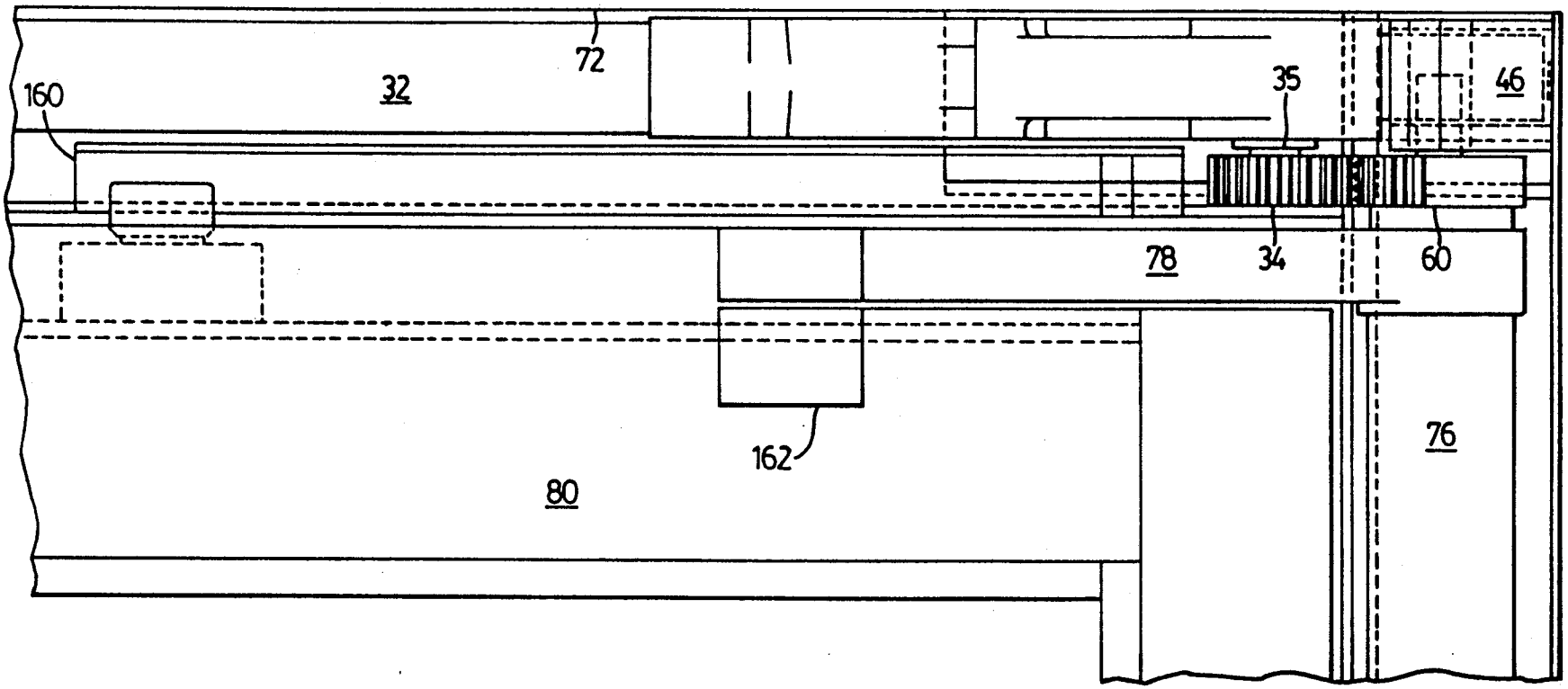
FIG. 7 is a side view of a door closing apparatus installed between the door frame and the door.

FIG. 7 shows a side view of the door closer assembly according to the present invention. As can be seen, the upper edge of the door 80 includes two components, namely, a guide track roller 160 and the top door pivot 162. Extending from the top door pivot 162 is the balanced door upper arm 78 which is attached to the balanced door hinge shaft 76 located inside the side jamb 70. The door closer 32 in turn is mounted in the header 72 above the guide track 82 and has the first gear means 34 extending outwardly from the operative element or check shaft 35. The second gear means 60 is connected to the balanced door hinge shaft and the upper end of the balanced door shaft is supported in the split needle bearing 46.

The foregoing description is in relation to a preferred embodiment of this invention and it will be appreciated that some variations are possible within the broad cope of the invention as defined in the claims. Some of these variations have been discussed above, and others will be apparent to those skilled in the art.

We claim:

1. A door closing apparatus for use in association with a balanced door having a door frame comprising a header, a base, and a pair of side jambs to define the door opening, one of said jambs having a hinge shaft disposed therein, and a door mounted in said door opening on an upper door pivot arm and a lower door pivot arm extending from said hinge shaft, said door having at least one guide roller guided by said frame, said door closing apparatus being mounted between the door and the frame, and comprising:

a door closer body having an operative element extending from one end of said body;

a first gear means having a first effective diameter connected to said operative element; and a second gear means having a second effective diameter mounted on an end of said hinge shaft;

wherein said door closer body is mounted adjacent said hinge shaft and said first gear means engages said second gear means to operatively connect said door closer to said door.

2. A balanced door closing apparatus as claimed in claim 1 wherein a ratio between said second gear means and said first gear means is greater than one, wherein said first gear means rotates more than said second gear means.

3. A balanced door closing apparatus as claimed in claim 2 wherein said ratio is greater than 1.5.

4. A balanced door closing apparatus as claimed in claim 2 wherein said ratio is 1.778.

5. A balanced door closing apparatus as claimed in claim 1 wherein when said second gear means rotates 90°, said first gear means rotates about 160°.

6. A balanced door closing apparatus as claimed in claim 1 wherein said first and second gear means are contained within said header.

7. A balanced door closing apparatus as claimed in claim 6 wherein said end of said door closer having said operative element is located adjacent said hinge shaft.

8. A balanced door closing apparatus as claimed in claim 1 wherein said header includes a mounting means for mounting said door closer in said operative position.

9. A balanced door closing apparatus as claimed in claim 8 wherein said mounting means includes screws to secure said first gear means, said second gear means and said operative element in said operative position.

10. A balanced door closing apparatus as claimed in claim 9 wherein said hinge shaft includes an projection at an upper end, and wherein said projection is secured within a split bearing.

* * * * *